US007950361B2

(12) United States Patent
Takenaka

(10) Patent No.: US 7,950,361 B2
(45) Date of Patent: May 31, 2011

(54) VALVE TIMING CONTROL APPARATUS

(75) Inventor: Akihiko Takenaka, Anjo (JP)

(73) Assignee: Denso Corporation, Kariya (JP)

( * ) Notice: Subject to any disclaimer, the term of this patent is extended or adjusted under 35 U.S.C. 154(b) by 329 days.

(21) Appl. No.: 12/269,096

(22) Filed: Nov. 12, 2008

(65) Prior Publication Data

US 2009/0133651 A1 May 28, 2009

(30) Foreign Application Priority Data

Nov. 28, 2007 (JP) ..... 2007-307989

(51) Int. Cl.
*F01L 1/34* (2006.01)

(52) U.S. Cl. ..... 123/90.17; 123/90.12; 123/90.15; 464/160; 137/511

(58) Field of Classification Search ..... 123/90.12, 123/90.13, 90.15, 90.16, 90.17, 90.18; 464/1, 464/2, 160; 137/511, 512, 512.15
See application file for complete search history.

(56) References Cited

U.S. PATENT DOCUMENTS

| | | | |
|---|---|---|---|
| 5,002,023 | A | 3/1991 | Butterfield et al. |
| 5,046,460 | A | 9/1991 | Butterfield et al. |
| 5,107,804 | A | 4/1992 | Becker et al. |
| 5,172,659 | A | 12/1992 | Butterfield et al. |
| 5,626,116 | A | 5/1997 | Reedy et al. |
| 7,124,722 | B2 | 10/2006 | Smith |
| 2005/0103297 | A1 | 5/2005 | Simpson |
| 2006/0086332 | A1 | 4/2006 | Simpson et al. |
| 2009/0071426 | A1 | 3/2009 | Knecht et al. |

FOREIGN PATENT DOCUMENTS

| | | |
|---|---|---|
| JP | 2006-63835 | 3/2006 |

OTHER PUBLICATIONS

Japanese Office Action dated Nov. 4, 2009, issued in corresponding Japanese Application No. 2007-307989, with English translation.

*Primary Examiner* — Ching Chang
(74) *Attorney, Agent, or Firm* — Nixon & Vanderhye PC

(57) ABSTRACT

An advancing check valve is placed in an advancing connection passage of a spool to enable a flow of hydraulic fluid in a first direction from a retarding port side toward an advancing port side upon placement of the spool in an advancing position and to limit a flow of hydraulic fluid in a second direction from the advancing port side toward the retarding port side upon placement of the spool in the advancing position. A retarding check valve is placed in a retarding connection passage of the spool to enable a flow of hydraulic fluid in the second direction upon placement of the spool in a retarding position and to limit a flow of hydraulic fluid in the first direction upon placement of the spool in the retarding position.

2 Claims, 8 Drawing Sheets

VALVE TIMING CONTROL APPARATUS

CROSS REFERENCE TO RELATED APPLICATION

This application is based on and incorporates herein by reference Japanese Patent Application No. 2007-307989 filed on Nov. 28, 2007.

BACKGROUND OF THE INVENTION

1. Field of the Invention

The present invention relates to a valve timing control apparatus that controls valve timing of at least one valve, which is driven by a camshaft through transmission of a torque from a crankshaft of an internal combustion engine.

2. Description of Related Art

A known valve timing control apparatus of a fluid drive type has a housing and a vane rotor. The housing serves as a driving-side rotator, which is rotated synchronously with a crankshaft. The vane rotor serves as a driven-side rotator, which is rotated synchronously with a camshaft. Japanese Unexamined Patent Publication No. 2006-63835 discloses this type of valve timing control apparatus, in which hydraulic fluid is supplied to advancing chambers or retarding chambers, each of which extends in a rotational direction and is defined between a corresponding shoe of the housing and a corresponding vane of the vane rotor, so that the camshaft is driven relative to the crankshaft in the advancing direction or the retarding direction to adjust the valve timing.

Here, in the valve timing control apparatus of Japanese Unexamined Patent Publication No. 2006-63835, a spool valve is used to change communication of a supply passage, into which the hydraulic fluid is supplied from a pump, to the advancing chambers or the retarding chambers. Specifically, at the time of changing the phase (hereinafter, referred to as an engine phase) of the camshaft relative to the crankshaft toward the advancing side, a port, which is communicated with the supply passage, is communicated with a port, which is communicated with the advancing chambers, by moving a spool of the spool valve to a corresponding position. Furthermore, at the time of changing the engine phase toward the retarding side, the port, which is communicated with the supply passage, is communicated with a port, which is communicated with the retarding chambers, by moving the spool to a corresponding position.

In the valve timing control apparatus of Japanese Unexamined Patent Publication No. 2006-63835, the variable torque is varied between the negative torque side for advancing the camshaft relative to the crankshaft and the positive torque side for retarding the camshaft relative to the crankshaft. Here, the variable torque is always applied during the operation of the internal combustion engine by, for example, a spring reaction force of the valves, which are driven by the camshaft. The amount of the variable torque changes depending on the rotational state of the internal combustion engine.

Therefore, in the case of changing the engine phase toward the advancing side, when the amount of supply of the hydraulic fluid from the pump is relatively small at the time of applying the negative torque as the variable torque, the hydraulic fluid becomes deficient in the advancing chambers, the volume of which is increased by the action of the negative torque. Thus, when the variable torque is reversed from the negative torque to the positive torque, the retardation of the camshaft cannot be limited due to the deficient of the working fluid. As a result, the response at the time of advancing the engine phase is disadvantageously deteriorated. The deterioration of the response also occurs at the time of changing the engine phase toward the retarding side. Therefore, it is desirable to take appropriate measures for both of the advancing side change and the retarding side change of the engine phase.

SUMMARY OF THE INVENTION

The present invention is made in view of the above disadvantage. Thus, it is an objective of the present invention to provide a valve timing control apparatus, which exhibits improved response. According to the present invention, there is provided a valve timing control apparatus that controls valve timing of at least one valve of an internal combustion engine, which is driven by a camshaft through transmission of a torque from a crankshaft of the internal combustion engine to open and close the at least one valve. The valve timing control apparatus includes a driving-side rotator, a driven-side rotator and a spool valve. The driving-side rotator is rotatable synchronously with the crankshaft. The driven-side rotator is rotatable synchronously with the camshaft. The driving-side rotator and the driven side rotator form an advancing chamber and a retarding chamber therebetween. The camshaft is driven relative to the crankshaft in one of an advancing direction and a retarding direction when hydraulic fluid is supplied to corresponding one of the advancing chamber and the retarding chamber. The spool valve includes an advancing port, a retarding port, a supply port, a spool, an advancing connection passage, an advancing check valve, a retarding connection passage and a retarding check valve. The advancing port is communicated with the advancing chamber. The retarding port is communicated with the retarding chamber. The supply port receives hydraulic fluid from an external fluid supply source. The spool is reciprocally drivable. The spool is driven to an advancing position to communicate the advancing port to the supply port at time of advancing a phase of the camshaft relative to the crankshaft and is driven to a retarding position to communicate the retarding port to the supply port at time of retarding the phase of the camshaft relative to the crankshaft. The advancing connection passage is formed in the spool and connects between the advancing port and the retarding port at the time of placing the spool in the advancing position. The advancing check valve is placed in the advancing connection passage to enable a flow of hydraulic fluid in a first direction from the retarding port side toward the advancing port side upon placement of the spool in the advancing position and to limit a flow of hydraulic fluid in a second direction from the advancing port side toward the retarding port side upon placement of the spool in the advancing position. The retarding connection passage is formed in the spool and connects between the advancing port and the retarding port upon placement of the spool in the retarding position. The retarding check valve is placed in the retarding connection passage to enable a flow of hydraulic fluid in the second direction upon placement of the spool in the retarding position and to limit a flow of hydraulic fluid in the first direction upon placement of the spool in the retarding position.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

An embodiment of the present invention will be described with reference to the accompanying drawings.

Figure 1:
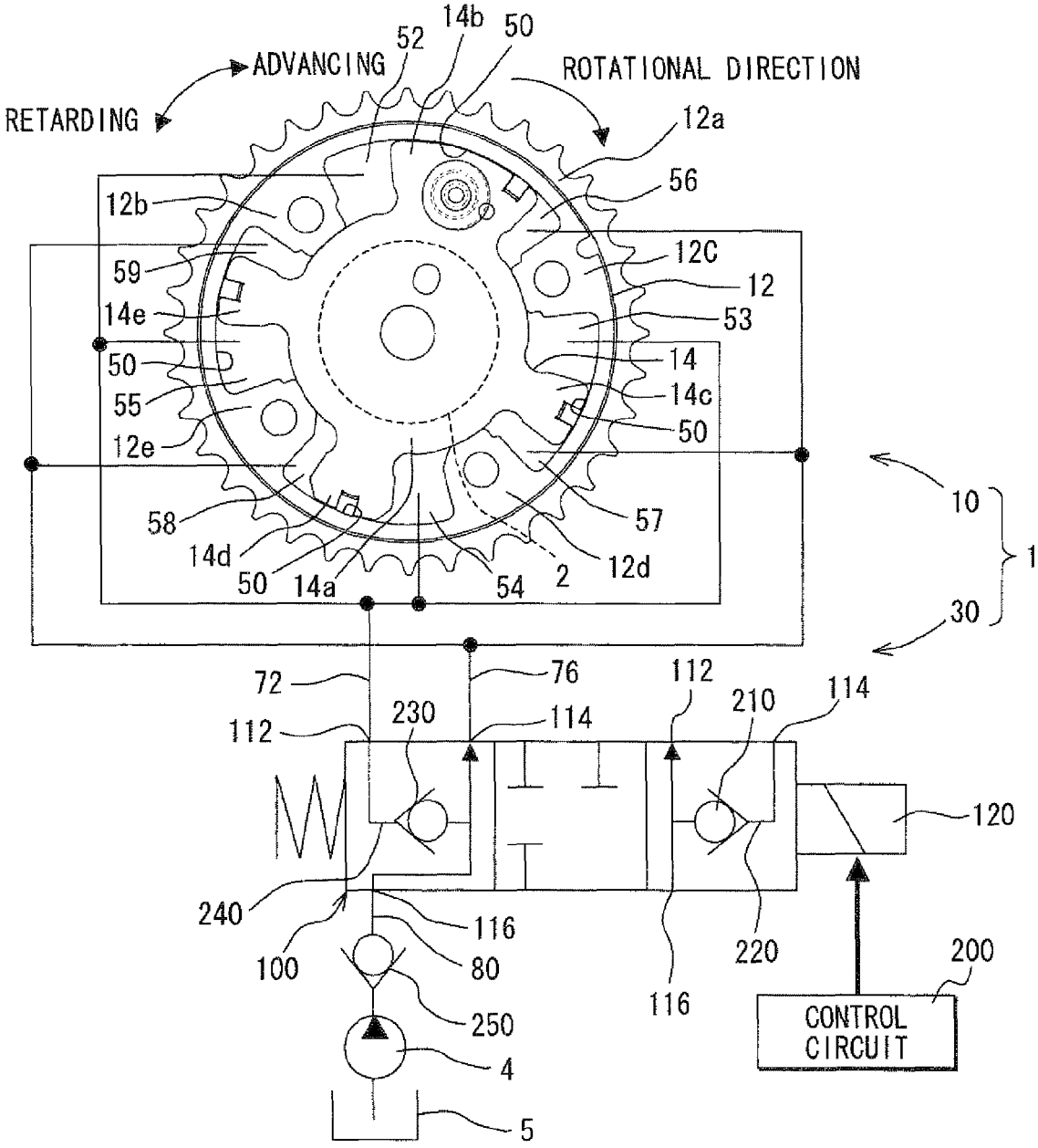
FIG. 1 is a schematic diagram showing a valve timing control apparatus according to an embodiment of the present invention.

FIG. 1 shows a valve timing control apparatus 1 of the first embodiment installed to an internal combustion engine of a vehicle. The valve timing control apparatus 1 is of a hydraulically controlled type, which uses hydraulic oil as working fluid to adjust the valve timing of intake valves.

Hereinafter, a basic structure of the valve timing control apparatus 1 will be described. The valve timing control apparatus 1 includes a drive device 10 and a control device 30. The drive device 10 is driven by the hydraulic oil and is provided in a drive force transmission system, which transmits a drive force of a crankshaft (not shown) of the internal combustion engine to a camshaft 2 of the internal combustion engine. The control device 30 controls supply of the hydraulic oil to the drive device 10.

In the drive device 10, a housing 12, which serves as a driving-side rotator, includes a generally cylindrical sprocket portion 12*a* and a plurality of shoes (serving as partitions) 12*b*-12*e*.

The sprocket portion 12*a* is connected to the crankshaft through a timing chain (not shown). With the above construction, at the time of driving the internal combustion engine, the drive force is transmitted from the crankshaft to the sprocket portion 12*a*, and thereby the housing 12 is rotated synchronously with the crankshaft in a clockwise direction in FIG. 1.

The shoes 12*b*-12*e* are arranged one after another along the sprocket portion 12*a* at generally equal intervals in the rotational direction of the sprocket portion 12*a* and radially inwardly project. A projecting end surface of each shoe 12*b*-12*e* forms an arcuate concave surface when it is viewed in a direction perpendicular to the plane of FIG. 1. The projecting end surface of each shoe 12*b*-12*e* slidably engages an outer peripheral wall surface of a boss 14*a* of a vane rotor 14. A receiving chamber 50 is formed between each adjacent two of the shoes 12*b*-12*e*, which are adjacent to each other in the rotational direction.

The vane rotor 14, which serves as a driven-side rotator, is received in the housing 12 and slidably engages the housing 12 in the axial direction. The vane rotor 14 includes the cylindrical boss 14*a* and a plurality of vanes 14*b*-14*e*.

The boss 14*a* is coaxially fixed to the camshaft 2 with a bolt. Thereby, the vane rotor 14 rotates in the clockwise direction in FIG. 1 synchronously with the camshaft 2 and can rotate relative to the housing 12.

The vanes 14*b*-14*e*, which are placed one after another at the generally equal intervals in the rotational direction at the boss 14*a*, radially outwardly project from the boss 14*a* and are received in the receiving chambers 50, respectively. A projecting end surface of each vane 14*b*-14*d* forms an arcuate convex surface as viewed in the direction perpendicular to the plane of FIG. 1 and is slidably engaged with the inner peripheral wall surface of the sprocket portion 12*a*.

Each vane 14*b*-14*e* divides the corresponding receiving chamber 50 to form an advancing chamber and a retarding chamber relative to the housing 12. Specifically, the advancing chamber 52 is formed between the shoe 12*b* and the vane 14*b*, and the advancing chamber 53 is formed between the shoe 12*c* and the vane 14*c*. Furthermore, the advancing chamber 54 is formed between the shoe 12*d* and the vane 14*d*, and the advancing chamber 55 is formed between the shoe 12*e* and the vane 14*e*. Also, the retarding chamber 56 is formed between the shoe 12*c* and the vane 14*b*, and the retarding chamber 57 is formed between the shoe 12*d* and the vane 14*c*. Also, the retarding chamber 58 is formed between the shoe 12*e* and the vane 14*d*, and the retarding chamber 59 is formed between the shoe 12*b* and the vane 14*e*.

In the drive device 10, when the hydraulic oil is supplied to the respective advancing chambers 52-55, the vane rotor 14 is rotated in the advancing direction relative to the housing 12, so that the camshaft 2 is driven in the advancing direction relative to the crankshaft. Therefore, in this case, the engine phase, which determines the valve timing, is changed in the advancing direction. Furthermore, in the drive device 10, when the hydraulic oil is supplied to the respective retarding chambers 56-59, the vane rotor 14 is rotated in the retarding direction relative to the housing 12, so that the camshaft 2 is driven in the retarding direction relative to the crankshaft. Therefore, in this case, the engine phase is changed in the retarding direction.

In the control device 30, an advancing passage 72, which extends through the camshaft 2 and a bearing (not shown) thereof, is communicated with the advancing chambers 52-55. Furthermore, a retarding passage 76, which extends through the camshaft 2 and the bearing thereof, is communicated with the retarding chambers 56-59.

A supply passage 80 is communicated with an outlet opening of a pump (a fluid supply source) 4 to receive the hydraulic oil, which is pumped from an oil pan 5 by the pump 4. The pump 4 of the present embodiment is a mechanical pump, which is driven by the crankshaft. At the time of driving the internal combustion engine, the hydraulic oil is continuously supplied to the supply passage 80.

The spool valve 100 is a solenoid control valve, which linearly and reciprocally drives a spool through use of an electromagnetic drive force generated from a solenoid 120. The spool valve 100 includes an advancing port 112, a retarding port 114 and a supply port 116. The advancing port 112 is communicated with the advancing chambers 52-55 through the advancing passage 72. The retarding port 114 is communicated with the retarding chambers 56-59 through the retarding passage 76. The supply port 116 receives the hydraulic oil from the pump 4 through the supply passage 80. Thus, in the spool valve 100, the spool is reciprocally driven through energization of the solenoid 120 to change the port, which is communicated with the supply port 116, between the advancing port 112 and the retarding port 114.

A control circuit 200 includes, for example, a microcomputer and is electrically connected to the solenoid 120 of the spool valve 100. The control circuit 200 controls the energization of the solenoid 120 and the operation of the internal combustion engine.

In the control device 30, the spool of the spool valve 100 is driven through the energization of the solenoid 120, which is controlled by the control circuit 200, so that the communicating states of the ports 112, 114 relative to the supply port 116 are controlled. Thereby, when the advancing port 112 is communicated with the supply port 116, the hydraulic oil, which is supplied from the pump 4 to the supply passage 80, is provided to the advancing chambers 52-55 through the advancing passage 72. Furthermore, when the retarding port 114 is communicated with the supply port 116, the hydraulic oil, which is supplied from the pump 4 to the supply passage 80, is provided to the retarding chambers 56-59 through the retarding passage 76.

Hereinafter, characteristics of the valve timing control apparatus 1 will be described.

Figure 2:
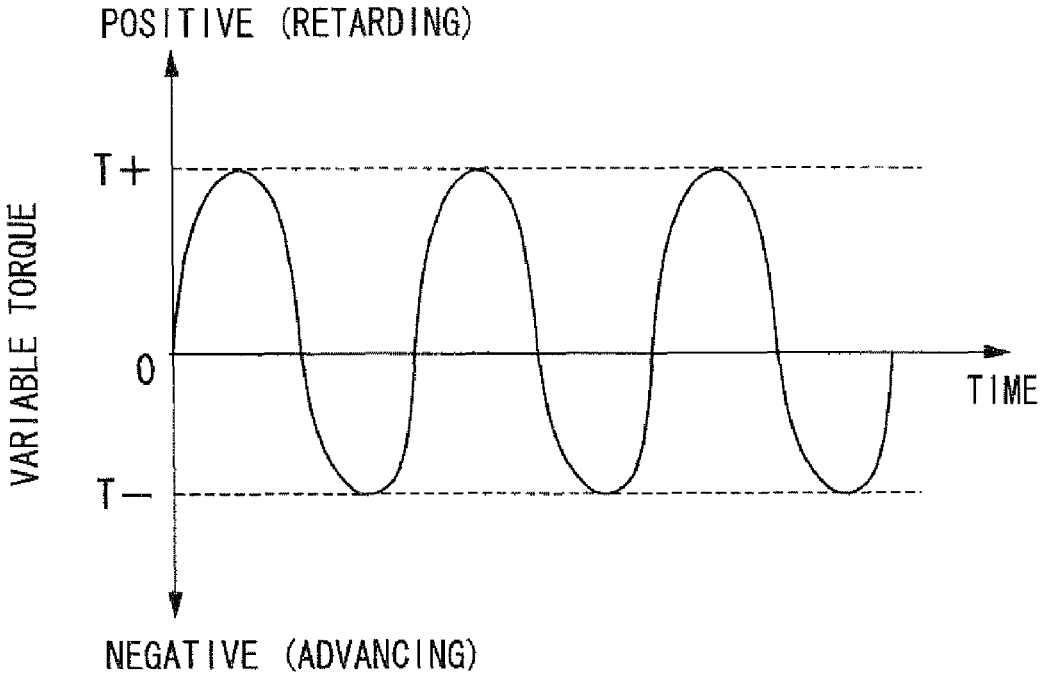
FIG. 2 is a diagram for describing a variable torque applied to a drive device shown in FIG. 1.

At the time of driving the internal combustion engine, the variable torque, which is generated due to, for example, a spring reaction force applied from the intake valves that are opened and closed by the camshaft 2, is applied to the vane rotor 14 of the drive device 10 through the camshaft 2. As shown in FIG. 2, the variable torque periodically varies between a negative torque, which causes the advancing of the camshaft 2 relative to the crankshaft, and a positive torque, which causes the retarding of the camshaft 2 relative to the crankshaft. For example, the variable torque can be set such that an absolute value of a peak T+ of the positive torque is substantially equal to an absolute value of a peak T− of the negative torque, so that an average torque becomes substantially zero. Alternatively, the variable torque can be set such that the absolute value of the peak T+ of the positive torque is larger than the absolute value of the peak T− of the negative torque, so that an average torque is deviated on the positive torque side.

Figure 3:
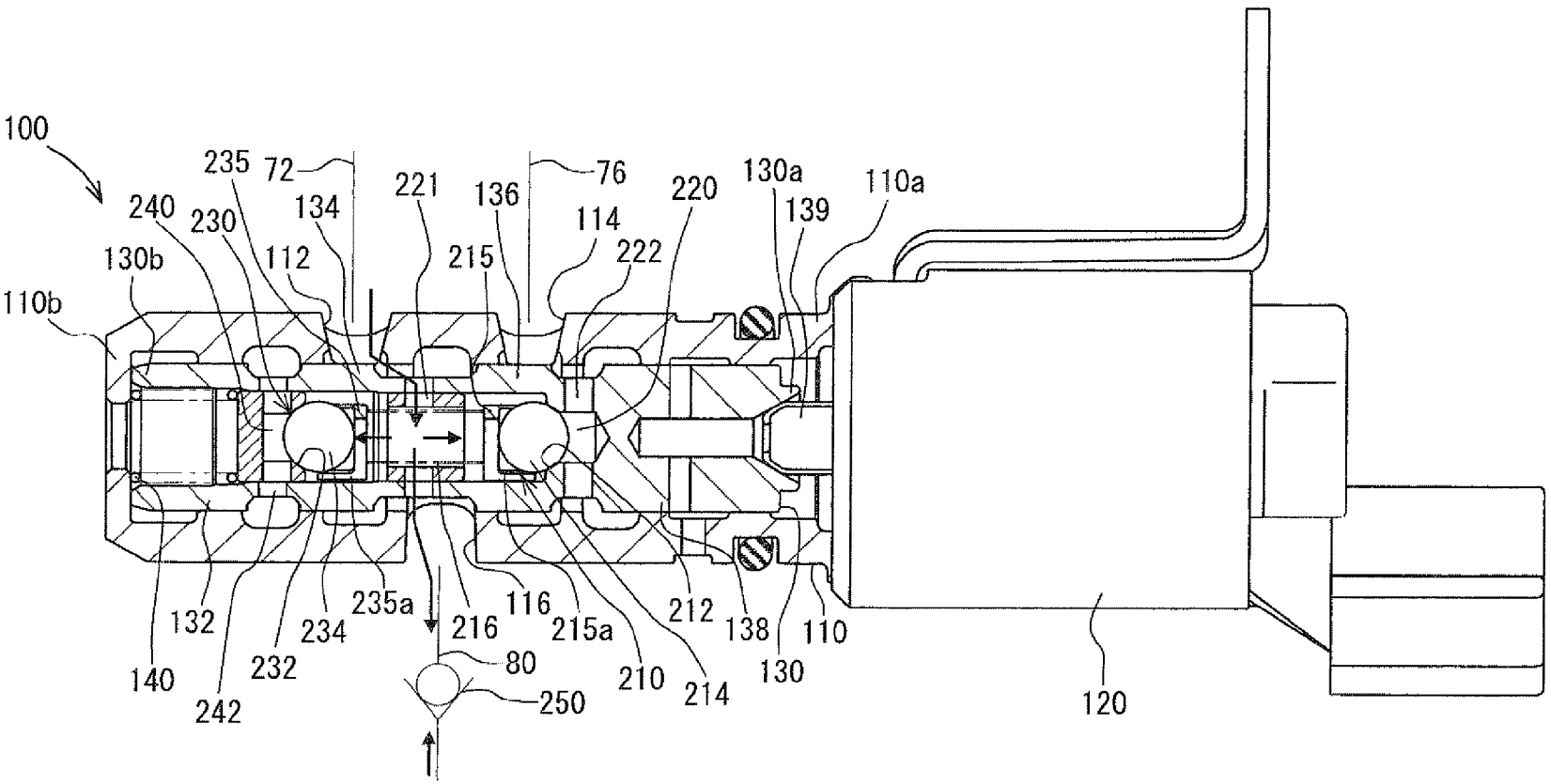
FIG. 3 is a schematic cross sectional view for describing a detailed structure and an operational state of a spool valve shown in FIG. 1.

As shown in FIG. 3, the spool valve 100 of the present embodiment includes a sleeve 110, the solenoid 120, the spool 130, a drive shaft 139 and a return spring 140.

The sleeve 110 is made of metal and is configured into a generally cylindrical body. The solenoid 120 is fixed to one end portion 110*a* of the sleeve 110. In the sleeve 110, the retarding port 114, the supply port 116 and the advancing port 112 are arranged in this order from the one end portion 110*a* side to the other end portion 110*b* side.

Figure 4:
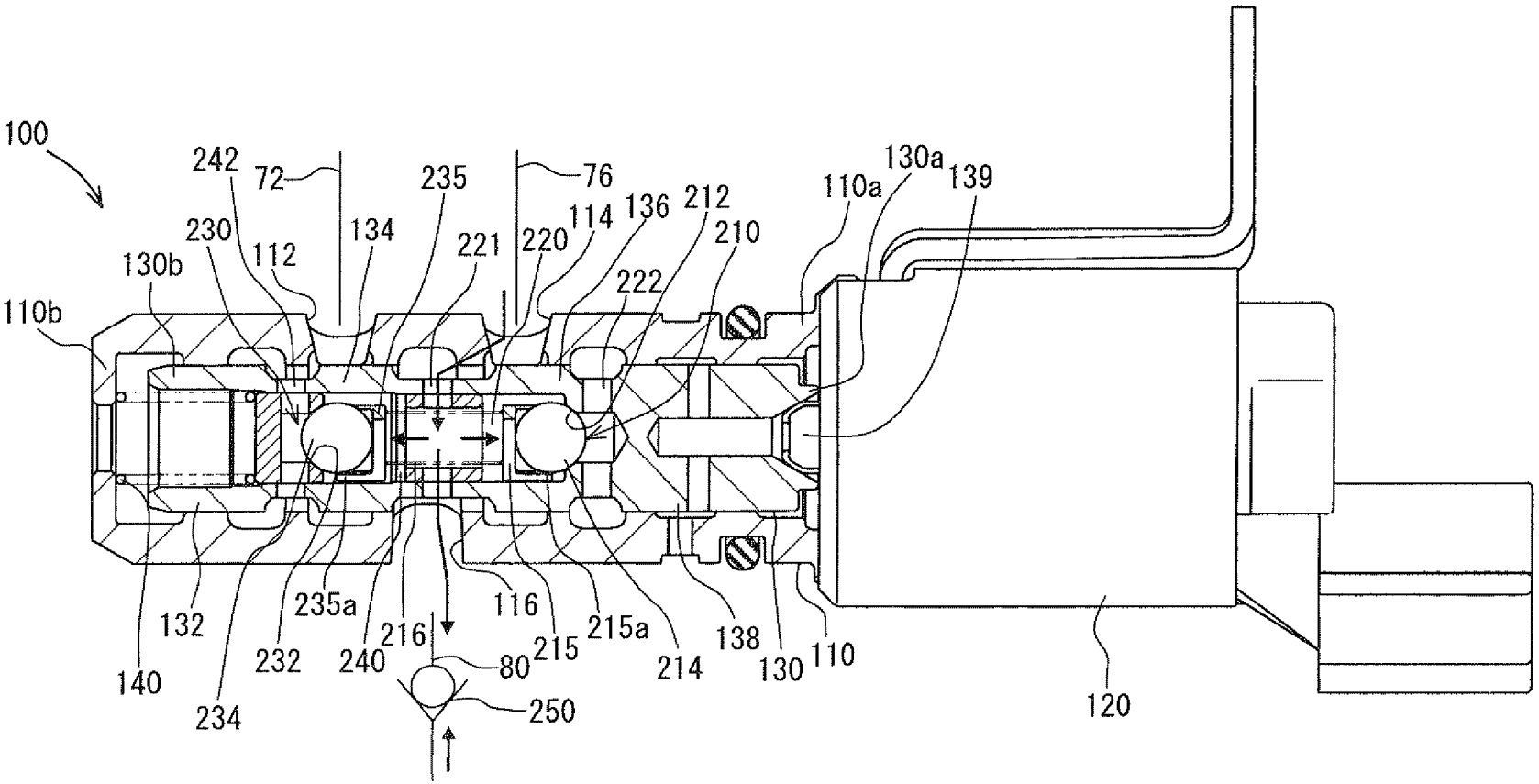
FIG. 4 is a schematic cross sectional view, showing an operational state of the spool valve shown in FIG. 1.
Figure 5:
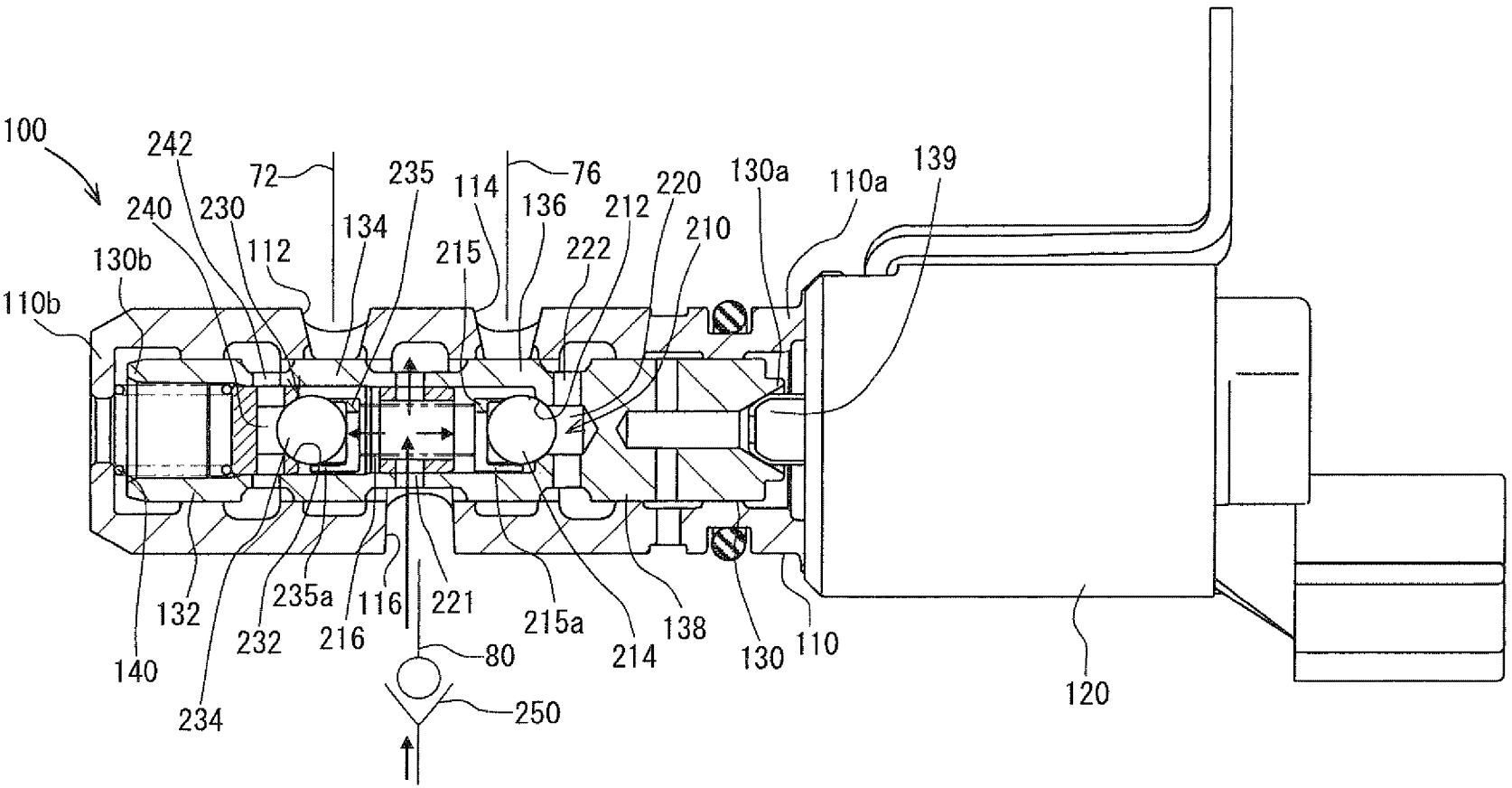
FIG. 5 is a schematic cross sectional view, showing another operational state of the spool valve shown in FIG. 1.

The spool 130 is made of metal and is configured into a rod-shaped body and is coaxially received in the sleeve 110. The drive shaft 139, which is electromagnetically driven by the solenoid 120, is coaxially connected to one end portion 130*a* of the spool 130, and thereby the spool 130 is axially reciprocally driven together with the drive shaft 139. In the spool 130, an advancing support land 132, an advancing change land 134, a retarding change land and a retarding support land 138 are arranged in this order from the other end portion 130*b* side to the one end portion 130*a* side The advancing support land 132 is always slidably supported by the sleeve 110 on the end portion 110*b* side of the advancing port 112. The advancing change land 134 is always slidably supported by the sleeve 110 on at least one of the end portion 110*b* side of the advancing port 112 and the supply port 116 side of the advancing port 112. As shown in FIG. 3, when the advancing change land 134 is supported by the sleeve 110 only on the end portion 110*b* side of the advancing port 112, the advancing port 112 is communicated with the supply port 116 through the gap between the advancing change land 134 and the retarding change land 136. Furthermore, as shown in FIG. 4, when the advancing change land 134 is supported by the sleeve 110 only on the supply port 116 side of the advancing port 112, the advancing port 112 is communicated with the gap between the advancing support land 132 and the advancing change land 134. In addition, as shown in FIG. 5, when the advancing change land 134 is supported by the sleeve 110 on the end portion 110*b* side of the advancing port 112 and also the supply port 116 side of the advancing port 112, the advancing port 112 is closed.

As shown in FIG. 3, the retarding support land 138 is always slidably supported by the sleeve 110 on the end portion 110*a* side of the retarding port 114. The retarding change land 136 is slidably supported by the sleeve 110 on at least one of the supply port 116 side of the retarding port 114 and the end portion 110*a* side of the retarding port 114. As shown in FIG. 4, when the retarding change land 136 is supported by the sleeve 110 only on the end portion 110*a* side of the retarding port 114, the retarding port 114 is communicated with the supply port 116 through the gap between the advancing change land 134 and the retarding change land 136. Furthermore, as shown in FIG. 3, when the retarding change land 136 is supported by the sleeve 110 only on the supply port 116 side of the retarding port 114, the retarding port 114 is communicated with the gap between the retarding change land 136 and the retarding support land 138. In addition, as shown in FIG. 5, when the retarding change land 136 is supported by the sleeve 110 on the end portion 110*a* side of the retarding port 114 and also the supply port 116 side of the retarding port 114, the retarding port 114 is closed.

In the present embodiment, the supply port 116 is always communicated with the gap between the advancing change land 134 and the retarding change land 136.

The return spring 140 is constructed as a compression coil spring made of metal in the present embodiment and is received coaxially within the sleeve 110. The return spring 140 is interposed between the end portion 110*b* and the advancing support land 132 in the sleeve 110 at the side opposite from the solenoid 120. The return spring 140 is compressively deformable to exert a restoring force for urging the spool 130 toward the solenoid 120 side in the axial direction. Furthermore, when the solenoid 120 is energized, the solenoid 120 exerts the electromagnetic drive force to urge the spool 130 toward the return spring 140 side in the axial direction. Therefore, in the spool valve 100, the spool 130 is driven in response to the balance between the restoring force, which is exerted by the return spring 140, and the electromagnetic drive force, which is exerted by the solenoid 120.

As shown in FIGS. 1 and 3, according to the present embodiment, two check valves 210, 230 are provided in two connection passages 220, 240, respectively, of the spool valve 100.

Specifically, as shown in FIG. 3, one end portion 221 of the advancing connection passage 220, which is formed in the spool 130, opens to an outer peripheral surface of the spool 130 at a plurality of locations between the advancing change land 134 and the retarding change land 136. Therefore, as shown in FIG. 3, when the advancing port 112 is communicated with the supply port 116 through the gap between the advancing change land 134 and the retarding change land 136, the end portion 221 of the advancing connection passage 220 is communicated with the advancing port 112 through the gap between the advancing change land 134 and the retarding change land 136.

The other end portion 222 of the advancing connection passage 220 opens to the outer peripheral surface of the spool 130 at a plurality of locations between the retarding change land 136 and the retarding support land 138. Therefore, as shown in FIG. 3, when the retarding port 114 is communicated with the gap between the retarding change land 136 and the retarding support land 138, the end portion 222 of the advancing connection passage 220 is communicated with the retarding port 114 through the gap between the retarding change land 136 and the retarding support land 138.

The advancing check valve 210 is placed such that a direction from the one end portion 221 toward the other end portion 222 at the advancing connection passage 220 coincides with a valve closing direction of the advancing check valve 210, and an opposite direction from the other end portion 222 toward the one end portion 221 at the advancing connection passage 220 coincides with a valve opening direction of the advancing check valve 210. The advancing check valve 210 of the present embodiment includes an advancing valve seat 212, an advancing valve member 214, an advancing retainer 215 and a resilient member 216.

The advancing valve seat 212 is configured into a generally conical surface, which has an inner diameter that is progressively reduced toward an end portion 222 side of an inner peripheral wall surface of the advancing connection passage 220. The advancing valve member 214 is made of metal and is configured into a ball. The advancing valve member 214 is placed on an end portion 221 side of the advancing valve seat 212 in the advancing connection passage 220 and is axially seatable and liftable with respect to the advancing valve seat 212. The advancing retainer 215 is made of metal and is configured into a cup shaped cylindrical body. The advancing retainer 215 is placed on a side of the advancing valve member 214, which is opposite from the advancing valve seat 212, in the advancing connection passage 220. An outer peripheral surface of a peripheral wall 215*a* of the advancing retainer 215 is axially reciprocally supported by an inner peripheral wall surface of the advancing connection passage 220. Furthermore, an inner peripheral surface of the peripheral wall 215*a* of the advancing retainer 215 holds the advancing valve member 214. The resilient member 216 is a compression coil spring made of metal in the present embodiment. The resilient member 216 is placed on a side of the advancing retainer 215, which is opposite from the advancing valve member 214. The resilient member 216 is interposed between the retarding check valve 230 and the advancing retainer 215, which are axially opposed to the advancing valve seat 212. The resilient member 216 is compressively deformable to exert a restoring force to urge the advancing valve member 214 toward the advancing valve seat 212 side through the advancing retainer 215. Specifically, the resilient member 216 serves as an advancing urging member of the advancing check valve 210.

Figure 6:
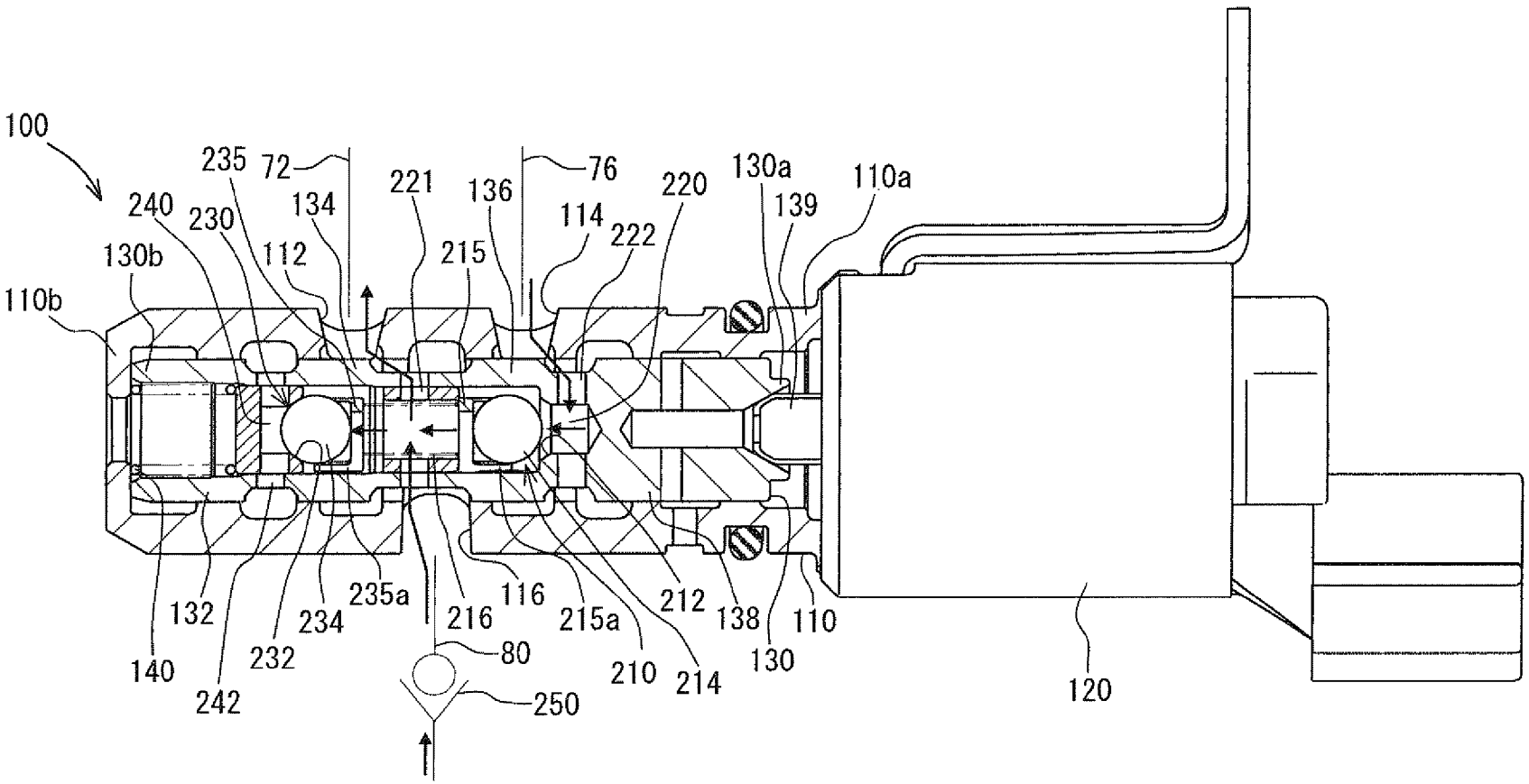
FIG. 6 is a schematic cross sectional view, showing another operational state of the spool valve shown in FIG. 1.

In the advancing check valve 210, as shown in FIG. 6, when the advancing valve member 214 is moved in the valve opening direction toward the end portion 221 side and is thereby lifted away from the advancing valve seat 212, the flow of the hydraulic oil in the valve opening direction is permitted. In contrast, in the advancing check valve 210, as shown in FIG. 3, when the advancing valve member 214 is moved in the valve closing direction toward the end portion 222 side and is thereby seated against the advancing valve seat 212, the flow of the hydraulic oil in the valve closing direction is limited.

As shown in FIG. 3, the retarding connection passage 240 is formed in the spool 130 to share the end portion 221 of the advancing connection passage 220. Specifically the end portion 221 is the common end portion 221, which is common to the advancing connection passage 220 and the retarding connection passage 240. Therefore, as shown in FIG. 4, when the retarding port 114 is communicated with the supply port 116 through the gap between the advancing change land 134 and the retarding change land 136, the common end portion 221 is communicated with the retarding port 114 through the gap between the advancing change land 134 and the retarding change land 136.

The other end portion 242 of the retarding connection passage 240 opens to the outer peripheral surface of the spool 130 at a plurality of locations between the advancing support land 132 and the advancing change land 134. Therefore, as shown in FIG. 4, when the advancing port 112 is communicated with the gap between the advancing support land 132 and the advancing change land 134, the end portion 242 of the retarding connection passage 240 is communicated with the advancing port 112 through the gap between the advancing support land 132 and the advancing change land 134.

The retarding check valve 230 is placed such that a direction from the common end portion 221 toward the other end portion 242 at the retarding connection passage 240 coincides with a valve closing direction of the retarding check valve 230, and an opposite direction from the other end portion 242 toward the common end portion 221 at the retarding connection passage 240 coincides with a valve opening direction of the retarding check valve 210. Here, similar to the advancing check valve 210, the retarding check valve 230 of the present embodiment includes a retarding valve seat 232, a retarding valve member 234, a retarding retainer 235 and the resilient member 216.

In the retarding check valve 230, the retarding valve seat 232 is configured into a generally conical surface, which has an inner diameter that is progressively reduced toward an end portion 242 side of an inner peripheral wall surface of the retarding connection passage 240. The retarding valve member 234 is provided on a common end portion 221 side of the retarding valve seat 232 in the retarding connection passage 240 and is axially seatable and liftable with respect to the retarding valve seat 232. The retarding retainer 235 is provided on a side of the retarding valve member 234, which is opposite from the retarding valve seat 232 in the retarding connection passage 240. Furthermore, an inner peripheral surface of the peripheral wall 235*a* of the retarding retainer 235, which is supported by the inner peripheral wall surface of the retarding connection passage 240, holds the retarding valve member 234. The resilient member 216, which is common to the advancing check valve 210, is provided on a side of the retarding retainer 235, which is opposite from the retarding valve member 234, in the retarding connection passage 240. The resilient member 216 is installed between the retarding valve member 234 and the advancing valve member 214 through the retainers 235, 215. Here, the retarding valve member 234 is placed on the forward side of the common end portion 221 in the valve closing direction of the retarding check valve 230, and the advancing valve member 214 is placed on the forward side of the common end portion 221 in the valve closing direction of the advancing check valve 210. The resilient member 216 is compressively deformable to exert the restoring force to urge the retarding valve member 234 toward the retarding valve seat 232 side through the retarding retainer 235. That is, the resilient member 216 also functions as a retarding urging member of the retarding check valve 230. With this construction, the structure is simplified, and the manufacturing costs are reduced.

Figure 7:
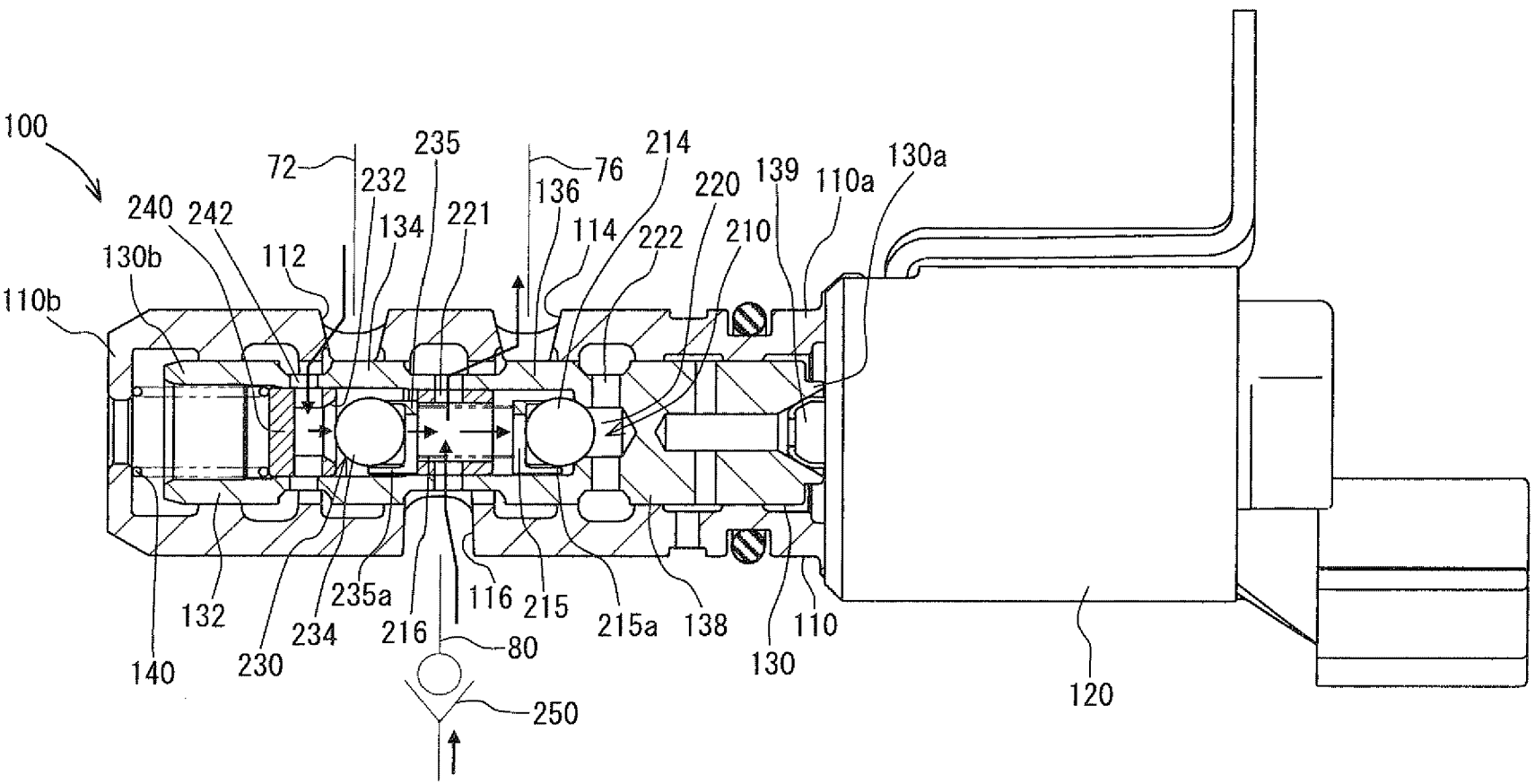
FIG. 7 is a schematic cross sectional view, showing another operational state of the spool valve shown in FIG. 1.

In the retarding check valve 230, as shown in FIG. 7 when the retarding valve member 234 is moved in the valve opening direction toward the common end portion 221 side and is thereby lifted away from the retarding valve seat 232, the flow of the hydraulic oil in the valve opening direction is permitted. In contrast, in the retarding check valve 230, as shown in FIG. 4, when the retarding valve member 234 is moved in the valve closing direction toward the end portion 242 side and is thereby seated against the retarding valve seat 232, the flow of the hydraulic oil in the valve closing direction is limited.

As shown in FIGS. 1 and 3, a supply check valve 250 is provided in the supply passage 80, which communicates between the pump 4 and the supply port 116. When the supply check valve 250 is opened in the manner shown in FIG. 5, the flow of the hydraulic oil from the pump 4 side toward the supply port 116, i.e., toward the downstream side of the supply passage 80 is permitted. When the supply check valve 250 is closed in the manner shown in FIG. 3, the flow of the hydraulic oil from the supply port 116 side toward the pump 4 side, i.e., the backflow of the hydraulic oil from the downstream side of the supply passage 80 can be limited.

At the time of driving the internal combustion engine, during which the pump 4 is driven, the control circuit 200 computes an actual engine phase of the camshaft 2 relative to the crankshaft and a target engine phase thereof. Then, based on the result of the computation, the control circuit 200 controls the electric power supply to the solenoid 120 of the spool valve 100. Thereby, the spool 130 of the spool valve 100 is moved to implement the corresponding supply of the hydraulic oil relative to the advancing chambers 52-55 and the retarding chambers 56-59, which corresponds to the operational position of the spool 130, 50 that the valve timing is adjusted. The valve timing adjusting operation of the valve timing control apparatus 1 of the present embodiment will now be described in detail.

Hereinafter, the operation for advancing the valve timing by advancing the engine phase of the camshaft 2 relative to the crankshaft will be described.

Upon satisfaction of a predetermined operational condition of the internal combustion engine, which indicates an off state of an accelerator of the vehicle or a state of a low to middle rotational speed and a high load of the internal combustion engine, the control circuit 200 controls the electric current supplied to the solenoid 120 to a value larger than a predetermined reference value Ib. Therefore, the spool 130 is moved to the advancing position shown in FIGS. 3 and 6 to communicate the advancing port 112 to the supply port 116. In this advancing position of the spool 130, the advancing connection passage 220 communicates between the advancing port 112, which is communicated with the common end portion 221, and the retarding port 114, which is communicated with the other end portion 222.

Therefore, as shown in FIG. 6, when the negative torque is applied to the vane rotor 14, the hydraulic oil, which is supplied from the pump 4 to the supply passage 80, is supplied to the advancing chambers 52-55 through the supply port 116 and the advancing port 112. At that time, the compressed hydraulic oil of the retarding chambers 56-59, which is compressed by the vane rotor 14 that receives the negative torque, is supplied from the retarding port 114 to the advancing connection passage 220. At this time, in the advancing check valve 210, the advancing valve member 214 is moved toward the common end portion 221 side against the pressure of the hydraulic oil supplied to the supply port 116 and the restoring force of the resilient member 216, so that the flow of the hydraulic oil from the retarding port 114 side to the advancing port 112 side is permitted. Therefore, when the amount of supply of the hydraulic oil from the pump 4 is reduced, the hydraulic oil can be supplemented from the retarding port 114 side. Therefore, it is possible to limit the shortage of the hydraulic oil at the advancing chambers 52-55, the volume of which is increased by the action of the negative torque. The hydraulic oil, which is supplied from the pump 4, flows into the retarding connection passage 240, which is communicated with the advancing port 112 at the common end portion 221. At this time, the flow of the hydraulic oil toward the end portion 242 side is limited by the retarding check valve 230.

When the positive torque is applied to the vane rotor 14 to compress the advancing chambers 52-55 with the vane rotor 14, the hydraulic oil tries to flow backward from the advancing port 112 toward the respective connection passages 220, 240 and the supply passage 80, as shown in FIG. 3. However, at this time, the flow of the hydraulic oil toward the retarding port 114 side in the advancing connection passage 220 is limited by the advancing check valve 210, and the flow of the hydraulic oil toward the end portion 242 side in the retarding connection passage 240 is limited by the retarding check valve 230. Furthermore, in the supply passage 80, the flow of the hydraulic oil toward the pump 4 side is limited by the supply check valve 250. Therefore, the outflow of the hydraulic oil from the advancing chambers 52-55 is limited while the erroneous supply of the hydraulic oil to the retarding chambers 56-59 is avoided.

When the above advancing operation is executed, the function of the respective check valves 210, 230 is appropriately implemented to drain the hydraulic oil from the retarding chambers 56-59, and at the same time, the sufficient amount of the hydraulic oil can be supplied to the advancing chambers 52-55. Thereby, the high advancing response can be achieved.

Hereinafter, the operation for retarding the valve timing by retarding the engine phase of the camshaft 2 relative to the crankshaft will be described.

Upon satisfaction of an operational condition, which indicates a normal operational state of the internal combustion engine with the low load of the internal combustion engine, the control circuit 200 controls the electric current supplied to the solenoid 120 to a lower value that is lower than the reference value Ib. Therefore, the spool 130 is moved to the retarding position shown in FIGS. 4 and 7 to communicate the retarding port 114 to the supply port 116. In this retarding position of the spool 130, the retarding connection passage 240 communicates between the retarding port 114, which is communicated with the common end portion 221, and the advancing port 112, which is communicated with the other end portion 242.

Therefore, as shown in FIG. 7, when the positive torque is applied to the vane rotor 14, the hydraulic oil, which is supplied from the pump 4 to the supply passage 80, is supplied to the retarding chambers 56-59 through the supply port 116 and the retarding port 114. At that time, the compressed hydraulic oil of the advancing chambers 52-55, which is compressed by the vane rotor 14 that receives the positive torque, is supplied from the advancing port 112 to the retarding connection passage 240. At this time, in the retarding check valve 230, the retarding valve member 234 is moved toward the common end portion 221 side against the pressure of the hydraulic oil supplied to the supply port 116 and the restoring force of the resilient member 216, so that the flow of the hydraulic oil from the advancing port 112 side to the retarding port 114 side is permitted. Therefore, when the amount of supply of the hydraulic oil from the pump 4 is reduced, the hydraulic oil can be supplemented from the advancing port 112 side. Therefore, it is possible to limit the shortage of the hydraulic oil at the retarding chambers 56-59, the volume of which is increased by the action of the positive torque. The hydraulic oil, which is supplied from the pump 4, flows into the advancing connection passage 220, which is communicated with the retarding port 114 at the common end portion 221. At this time, the flow of the hydraulic oil toward the end portion 222 side is limited by the advancing check valve 210.

When the negative torque is applied to the vane rotor 14 to compress the retarding chambers 56-59 with the vane rotor 14, the hydraulic oil tries to flow backward from the retarding port 114 toward the respective connection passages 220, 240 and the supply passage 80, as shown in FIG. 4. However, at this time, the flow of the hydraulic oil toward the advancing port 112 side in the retarding connection passage 240 is limited by the retarding check valve 230, and the flow of the hydraulic oil toward the end portion 222 side in the advancing connection passage 220 is limited by the advancing check valve 210. Furthermore, in the supply passage 80, the flow of the hydraulic oil toward the pump 4 side is limited by the supply check valve 250. Therefore, the outflow of the hydraulic oil from the retarding chambers 56-59 is limited while the erroneous supply of the hydraulic oil to the advancing chambers 52-55 is avoided.

When the above retarding operation is executed, the function of the respective check valves 230, 210 is appropriately implemented to drain the hydraulic oil from the advancing chambers 52-55, and at the same time, the sufficient amount of the hydraulic oil can be supplied to the retarding chambers 56-59. Thereby, the high retarding response can be achieved.

Hereinafter, the operation for substantially holding the valve timing by holding the engine phase within a predetermined target phase range will be described.

When a predetermined operational condition, which indicates a stable operational state of the internal combustion engine (e.g., the holding sate of the accelerator of the vehicle), the control circuit 200 controls the current supplied to the solenoid 120 to the reference value Ib. Therefore, the spool 130 is moved to a holding position shown in FIG. 5 to block both of the advancing port 112 and the retarding port 114 relative to the supply port 116. In this holding position of the spool 130, the common end portion 221 of the advancing connection passage 220 and of the retarding connection passage 240 is communicated with the supply port 116 through the gap between the advancing change land 134 and the retarding change land 136. However, the other end portion 222 of the advancing connection passage 220 and the other end portion 242 of the retarding connection passage 240 are blocked from both of the advancing port 112 and the retarding port 114.

Therefore, the hydraulic oil, which is supplied from the pump 4 to the supply passage 80, is not supplied to both of the advancing chambers 52-55 and the retarding chambers 56-59, and also the outflow of the hydraulic oil from the advancing chambers 52-55 and the outflow of the hydraulic fluid from the retarding chambers 56-59 are limited. As a result, the change in the engine phase is limited, and thereby the valve timing is substantially maintained. The hydraulic oil, which is supplied from the pump 4, flows from the supply port 116 into the common end portion 221 of the advancing connection passage 220 and of the retarding connection passage 240. However, at this time, the flow of the hydraulic oil toward the other end portions 222, 242 is both limited by the check valves 210, 230.

According to the present embodiment, the valve timing adjustment, which is suitable for the internal combustion engine, is rapidly and appropriately performed.

The present invention has been described with respect to the embodiment of the present invention. However, the present invention is not limited to the above embodiment, and the above embodiment may be modified in various ways within a spirit and scope of the present invention.

Specifically, in the drive device 10, it is possible to provide a resilient member (e.g., an assist spring), which urges the camshaft 2 toward the opposite side that is opposite from the biased side of the average torque of the variable torque. Furthermore, in the drive device 10, the housing 12 may be rotated synchronously with the camshaft 2 to rotate the vane rotor 14 synchronously with the crankshaft.

Figure 8:
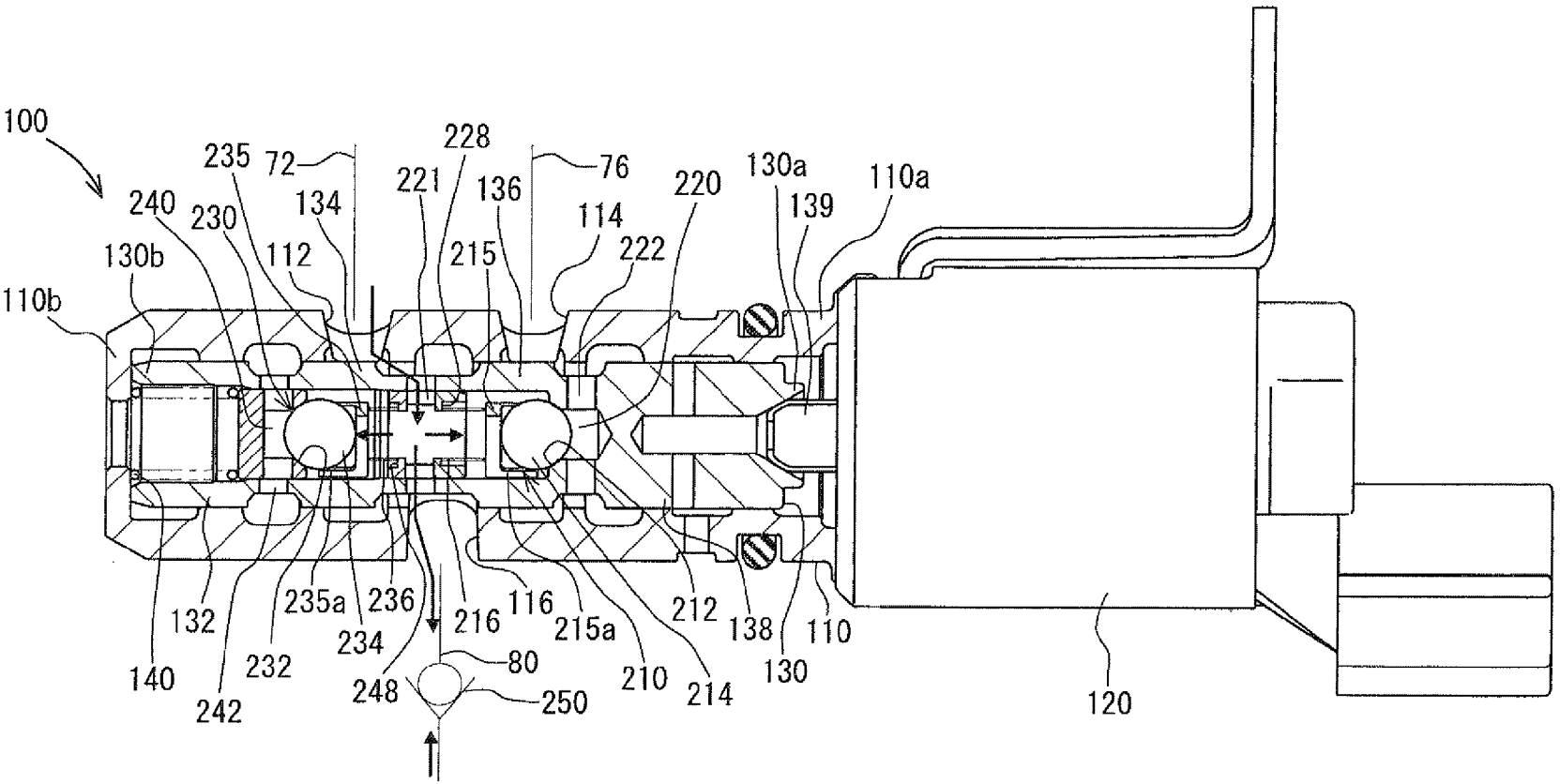
FIG. 8 is a schematic cross sectional view, showing a modification of the spool valve shown in FIG. 3.

In the spool valve 100 of the control device 30, as shown in FIG. 8, a retarding urging member 236 of the retarding check valve 230 may be provided separately from the resilient member 216, which serves as the advancing urging member of the advancing check valve 210. In such a case, the retarding urging member 236 may be constructed by the metal compression coil spring, which is interposed between the inner wall surface 248 of the retarding connection passage 240 and the retarding retainer 235, to generate the restoring force toward the retarding valve seat 232 side. Furthermore, the resilient member 216, which serves as the advancing urging member, is interposed between the inner wall surface 228 of the advancing connection passage 220 and the advancing retainer 215 to generate the restoring force toward the advancing valve seat 212 side. Furthermore, although not depicted in the drawings, the opposite end portion of the retarding connection passage 240, which is opposite from the end portion 242, may be separated from the opposite end portion of the advancing connection passage 220, which is opposite from the end portion 222.

Also, in the above embodiment, the spool valve 100 is constructed to drive the spool 130 by the solenoid 120. Alternatively, the spool 130 of the spool valve may be driven by, for example, a piezoelectric actuator. Furthermore, the spool valve 100 may be modified such that the port 114 is communicated with the advancing chambers 52-55 through the advancing passage 72, and the port 112 is communicated with the retarding chambers 56-59 through the retarding passage 76. In such a case, the position shown in FIGS. 3 and 6 becomes the retarding position for the retarding operation. Furthermore, the position shown in FIGS. 4 and 7 becomes the advancing position for the advancing operation.

Furthermore, the present invention is also applicable to any other type of valve timing control apparatus, which controls valve timing of exhaust valves or which controls both of the valve timing of the intake valves and the valve timing of the exhaust valves.

Additional advantages and modifications will readily occur to those skilled in the art. The invention in its broader terms is therefore not limited to the specific details, representative apparatus, and illustrative examples shown and described.

What is claimed is:

1. A valve timing control apparatus that controls valve timing of at least one valve of an internal combustion engine, which is driven by a camshaft through transmission of a torque from a crankshaft of the internal combustion engine to open and close the at least one valve, the valve timing control apparatus comprising:

a driving-side rotator that is rotatable synchronously with the crankshaft;

a driven-side rotator that is rotatable synchronously with the camshaft, wherein the driving-side rotator and the driven side rotator form an advancing chamber and a retarding chamber therebetween, and the camshaft is driven relative to the crankshaft in one of an advancing direction and a retarding direction when hydraulic fluid is supplied to corresponding one of the advancing chamber and the retarding chamber; and a spool valve that includes:

an advancing port that is communicated with the advancing chamber;

a retarding port that is communicated with the retarding chamber;

a supply port that receives hydraulic fluid from an external fluid supply source;

a spool that is reciprocally drivable, wherein the spool is driven to an advancing position to communicate the advancing port to the supply port at time of advancing a phase of the camshaft relative to the crankshaft and is driven to a retarding position to communicate the retarding port to the supply port at time of retarding the phase of the camshaft relative to the crankshaft;

an advancing connection passage that is formed in the spool and connects between the advancing port and the retarding port at the time of placing the spool in the advancing position;

an advancing check valve that is placed in the advancing connection passage in the spool to enable a flow of hydraulic fluid in a first direction from the retarding port side toward the advancing port side upon placement of the spool in the advancing position and to limit a flow of hydraulic fluid in a second direction from the advancing port side toward the retarding port side upon placement of the spool in the advancing position;

a retarding connection passage that is formed in the spool and connects between the advancing port and the retarding port upon placement of the spool in the retarding position; and a retarding check valve that is placed in the retarding connection passage in the spool to enable a flow of hydraulic fluid in the second direction upon placement of the spool in the retarding position and to limit a flow of hydraulic fluid in the first direction upon placement of the spool in the retarding position;

a supply passage that is communicated with the external fluid supply source and the supply port; and a supply check valve that is placed in the supply passage to enable a flow of hydraulic fluid from the external fluid supply source side toward the supply port side and to limit a flow of hydraulic fluid from the supply port side toward the external fluid supply source side, wherein:

the advancing check valve includes:

an advancing valve seat that is formed by an inner peripheral wall surface of the advancing connection passage;

an advancing valve member that is liftable from the advancing valve seat upon movement of the advancing valve member in the first direction and is seatable against the advancing valve seat upon movement of the advancing valve member in the second direction; and an advancing urging member that urges the advancing valve member in the second direction with use of a restoring force of the advancing urging member; and the retarding check valve includes:

a retarding valve seat that is formed by an inner peripheral wall surface of the retarding connection passage;

a retarding valve member that is liftable from the retarding valve seat upon movement of the retarding valve member in the second direction and is seatable against the retarding valve seat upon movement of the retarding valve member in the first direction; and a retarding urging member that urges the retarding valve member in the second direction with use of a restoring force of the retarding urging member;

the advancing connection passage and the retarding connection passage have a common end portion, which is formed in the spool and is common to the advancing connection passage and the retarding connection passage;

the common end portion is communicated with the advancing port upon movement of the spool to the advancing position; and the common end portion is communicated with the retarding port upon movement of the spool to the retarding position.

2. The valve timing control apparatus according to claim 1, wherein the advancing urging member and the retarding urging member are formed as a resilient member that is interposed between:

the advancing valve member, which is placed on a forward side of the common end portion in the second direction in the advancing connection passage; and the retarding valve member, which is placed on a forward side of the common end portion in the first direction in the retarding connection passage, wherein the resilient member is compressively deformable to exert a restoring force.

* * * * *